US010265741B1

(12) United States Patent
Kelyman

(10) Patent No.: US 10,265,741 B1
(45) Date of Patent: Apr. 23, 2019

(54) HIGH VOLUME FLOOR DUST CONTROL SYSTEM

(71) Applicant: Brunn Air Systems, Inc.

(72) Inventor: John Kelyman, Memphis, TN (US)

(73) Assignee: Brunn Air Systems, Inc., Memphis, TN (US)

( * ) Notice: Subject to any disclaimer, the term of this patent is extended or adjusted under 35 U.S.C. 154(b) by 0 days.

(21) Appl. No.: 15/911,159

(22) Filed: Mar. 4, 2018

Related U.S. Application Data

(62) Division of application No. 15/339,659, filed on Oct. 31, 2016, now abandoned.

(60) Provisional application No. 62/300,622, filed on Feb. 26, 2016.

(51) Int. Cl.

| | |
|---|---|
| ***A47L 5/14*** | (2006.01) |
| ***A47L 5/38*** | (2006.01) |
| ***B08B 5/02*** | (2006.01) |
| ***B08B 5/04*** | (2006.01) |
| ***D21G 9/00*** | (2006.01) |
| ***B08B 15/00*** | (2006.01) |

(52) U.S. Cl.
CPC ..... *B08B 5/046* (2013.01); *A47L 5/14* (2013.01); *A47L 5/38* (2013.01); *B08B 5/026* (2013.01); *B08B 15/002* (2013.01); *D21G 9/00* (2013.01)

(58) Field of Classification Search
CPC . A47L 5/38; A47L 5/14; B08B 15/002; B08B 5/026; B08B 5/046; F23J 1/00; D21G 9/00
USPC ..... 15/301, 309.1
See application file for complete search history.

(56) References Cited

U.S. PATENT DOCUMENTS

| | | | | | |
|---|---|---|---|---|---|
| 1,676,969 | A | * | 7/1928 | Sutton | B07B 11/00 15/301 |
| 1,921,900 | A | | 8/1933 | Wood | |
| 1,925,907 | A | | 9/1933 | Norris | |
| 1,958,225 | A | | 5/1934 | Joseph | |
| 2,633,070 | A | | 3/1953 | Gillham | |
| 2,702,504 | A | | 2/1955 | Guildford | |
| 2,898,836 | A | | 8/1959 | Lockheed | |
| 3,314,098 | A | * | 4/1967 | Carsey | B08B 15/002 15/301 |
| 3,343,197 | A | * | 9/1967 | Carsey | A47L 5/38 15/314 |
| 3,483,675 | A | | 12/1969 | King | |
| 3,509,911 | A | * | 5/1970 | Carsey | B08B 15/002 137/602 |
| 3,545,470 | A | | 12/1970 | Paton | |

(Continued)

FOREIGN PATENT DOCUMENTS

| | | | | |
|---|---|---|---|---|
| WO | WO 85/00764 | * | 2/1985 | B08B 15/04 |

*Primary Examiner* — Bryan R Muller
(74) *Attorney, Agent, or Firm* — United IP Counselors, LLC

(57) ABSTRACT

A high volume dust collector that is adapted and configured to reduce time associated with routine cleaning of an industrial tissue-machine and factory. The dust collector has a body, having an intake positioned to draw large volumes of air and dust from any area where dust is known to accumulate when engaged. The intake is taller than it is wide and is fitted with a grill to prevent larger maculature from clogging the system. An outlet on each collector connects to a fan or blower and sends collected dust to filtration system. An access hatch is positioned on the body of the collector to allow an operator to manually clear any clogs, should they occur.

17 Claims, 6 Drawing Sheets

(56) References Cited

U.S. PATENT DOCUMENTS

| | | | | | |
|---|---|---|---|---|---|
| 3,838,732 | A * | 10/1974 | Overmyer | B08B 15/02 | 164/131 |
| 4,318,337 | A * | 3/1982 | Wichmann | B08B 15/002 | 454/65 |
| 4,318,643 | A * | 3/1982 | Larsson | B65G 53/60 | 406/117 |
| 4,787,298 | A * | 11/1988 | Hon | B08B 15/002 | 454/345 |
| 4,805,521 | A | 2/1989 | Eckebring et al. | | |
| 4,929,262 | A | 5/1990 | Balon et al. | | |
| 5,183,077 | A * | 2/1993 | Keiper | F16K 11/0873 | 137/556.6 |
| 5,199,461 | A | 4/1993 | Carr | | |
| 5,516,329 | A * | 5/1996 | Dunn | B08B 15/002 | 454/64 |
| 6,012,199 | A * | 1/2000 | Litomisky | A47L 5/38 | 15/301 |
| 6,758,208 | B2 | 7/2004 | Giérula et al. | | |
| 7,909,686 | B2 | 3/2011 | Achen | | |
| 8,636,832 | B2 * | 1/2014 | Stutzman | B01D 45/08 | 55/356 |
| 2012/0322358 | A1 | 12/2012 | Wendorski et al. | | |

* cited by examiner

HIGH VOLUME FLOOR DUST CONTROL SYSTEM

CROSS-REFERENCE TO RELATED APPLICATIONS

This application is a divisional of U.S. patent application Ser. No. 15/339,659, filed Oct. 31, 2016, which claims priority to U.S. Provisional Application No. 62/300,622, filed Feb. 26, 2016. The contents of both of those applications are incorporated by reference in their entirety.

BACKGROUND OF THE INVENTION

1. Field of the Invention

In general, the invention relates to pneumatic collectors, and more specifically to pneumatic collectors for capturing dust in paper and tissue manufacturing processes.

2. Description of Related Art

Modern industrial tissue-making processes are typically performed using high-speed paper machines. In a typical process, a mixture of recycled fiber, virgin fiber, and filler material is continuously formed into a sheet, dried on a large cylinder called a yankee cylinder, and scraped from that cylinder to form a continuous web of tissue, which is ultimately wound onto a large roll, called a parent roll. The material on the parent roll is a single-ply tissue, but many tissue products use multiple plies of tissue, and thus, that single-ply parent roll must be further processed. Multiple webs of tissue may be combined into multi-ply products and wound onto a new roll with the aid of a tissue-combining re-winder machine.

In many tissue factories, a tissue-combining re-winder machine is an intermediate step between initial formation of a tissue web and creation of a final product. During this intermediate step, the machine unwinds two or three single-ply tissue webs from individual parent rolls, combining and then re-winding the laminated multi-ply tissue web on a larger parent roll. This combining process may reach speeds of 2,500-3,000 feet per minute (f/m). Such high-speeds produce excessive quantities of dust.

Both tissue-making machines and combining re-winder machines are often very large—the machines themselves may be, for example, 5.7 or 2.4 meters wide with a tissue web very nearly that wide. The speed of the machines and the volume of paper that passes through in a short period of time create a large volume of paper particles and dust. Excessive dust trapped in a final tissue product may cause the product to fail regulatory standards for good "sheet hygiene." More importantly, the dust is a health hazard for workers, and if it builds up enough, it may also be an explosion hazard. Beyond that, accumulated dust and paper may impede the web of tissue and require the machine to be shut down in order to clear clumps and accumulations.

The problem of dust—and dust control—is also exacerbated by the serpentine nature of the typical setup. As the sheet moves from the parent roll, is processed, and is rewound onto a finished roll, it typically passes through a maze of turns, which occur as the sheet is subjected to processes like ply bonding (i.e., mechanical joining of two sheets through friction and compression), calendaring (i.e., passing under rollers at high temperatures and pressures), and embossing (i.e., pressing a design into the final sheet).

Each of the steps above will open the sheet and, through centrifugal forces, discharge fiber and filler.

In order to prevent dust accumulation, dust extraction hoods are typically placed at strategic locations proximate to the machinery. However, the complex, serpentine arrangement of the machinery and the web can make it difficult to place hoods, or to place them in locations where they are likely to do the most good. Even with well-designed and positioned dust extraction hoods, dust may still accumulate in some areas, including the machinery and the floor of the factory. Cleaning the accumulated dust may require the process to be shut down for up to an hour and a half—valuable operator and production time lost while the machine is not in operation.

SUMMARY OF THE INVENTION

One aspect of the invention relates to a pneumatic dust collector for a paper- or tissue-making machine. The dust collector has a body with at least one air intake and an outlet. The intake is shaped and adapted to abut the floor and to create an air flow parallel to the floor, giving the body of the dust collector an L-shape. The intake may be relatively tall, and may also have a height at least somewhat greater than its width. In a typical embodiment, a grate is positioned over the intake to protect it. The outlet of the dust collector is typically connected to a fan or blower system, and several dust collectors may be spaced from one another along a factory floor and connected to the same fan or blower system. That same fan or blower system may provide airflow to a complementary dust hood system that collects dust while the machine is operating. In a typical installation, however, there may be more dust hoods than there are floor-based dust collectors, allowing the dust hoods to handle larger volumes of airflow. Inspection and cleaning hatches in the body of the dust collector may allow for cleaning and removal of any large clumps.

Another aspect of the invention also relates to pneumatic dust collectors. These dust collectors may be generally similar to the dust collectors described above. However, they typically have two intakes, instead of a single intake. A movable internal baffle within the body of the dust collector allows a user to select the relative volume of air flow that passes through each of the intakes.

Other aspects, features, and advantages of the invention will be set forth in the description that follows.

BRIEF DESCRIPTION OF THE DRAWING FIGURES

The invention will be described with respect to the following drawing figures, in which like numerals represent like elements throughout the figures, and in which.

DETAILED DESCRIPTION

Figure 1:
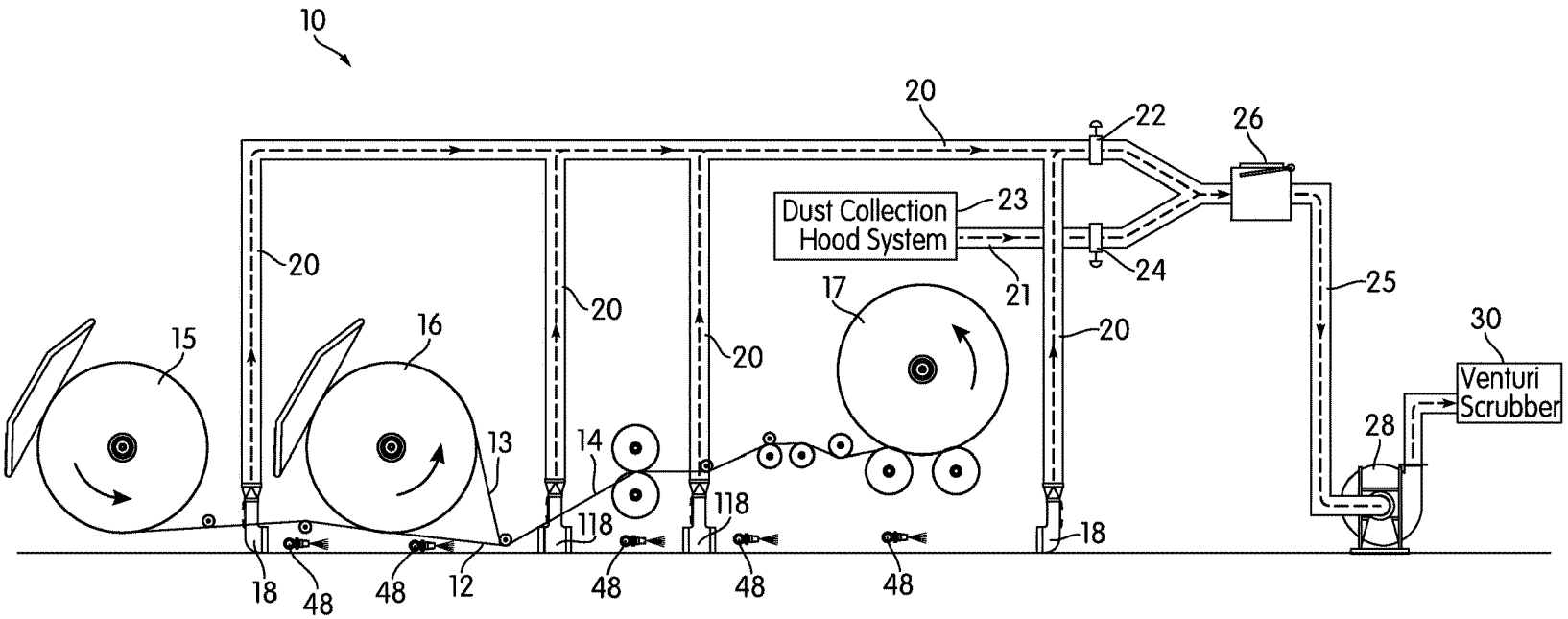
FIG. 1 is a schematic view of the combining section of a papermaking process, showing the installation of one or more high volume tissue cleaning hoods according to embodiments of the invention.

FIG. 1 is a schematic view of the combining side of a tissue-combining re-winder machine, generally indicated at 10. A first single-ply tissue web 12 is unwound from a first parent roll 15 and routed toward a second single-ply tissue web 13 that is simultaneously unwound from a second parent roll 16. For purposes of this description, the term "parent roll" refers to roll on which a dried tissue product from a typical tissue machine is temporarily wound and stored. Additionally, the term "ply" refers to the thickness or number of stacked or laminated layers of a combined tissue web. The two separate single-ply webs 12, 13 are combined into one final multi-ply (i.e., two-ply) tissue web 14 that is calendered and is ultimately wound onto a larger parent roll 17.

For purposes of the present invention, the machine 10 should be considered to be fairly typical, and the precise details of its operation are not critical to the invention. Moreover, while a particular type of machine is shown in FIG. 1, it should be understood that the hoods and other machines described here may be used with other types of machines and in other situations where large volumes of dust are generated.

A multi-faceted approach to controlling dust would typically be used in the illustrated embodiment. In this type of multi-faceted approach, many of the components will have pneumatic dust hoods positioned over parts of the machine 10 that produce particularly high levels of dust. These hoods may draw continuously, or continuously for defined intervals, with a draw or pressure drop significant enough to collect a significant portion of the generated dust. Other "overhead" systems, like baffles, may also be used to constrain the dust and to provide protection in case a web 12, 13 breaks. For an example of how this is done during a primary tissue web formation process, U.S. application Ser. No. 15/276,684, filed Sep. 26, 2016 and incorporated by reference herein in its entirety, illustrates the use of hoods and baffles, as well as the range of features that such "overhead" hoods may have. For simplicity in illustration, the individual overhead hoods are not shown in FIG. 1, although the dust collection hood system is shown generally in FIG. 1 at 23.

As was described above, in a typical process, some dust and particulate matter will nearly always collect on the floor, and depending on the particulars of the process, the amount of material that collects on the floor may be very significant. In addition to the dust hazards described above, piles of paper dust and maculature on the floor may impede personnel from moving around on the factory floor and carrying out their duties.

Thus, in the illustrated embodiment, in addition to the dust collection hood system 23, a number of high volume pneumatic dust collectors 18 are positioned along the length of the machine 10. Each dust collector 18 is positioned to collect dust below the webs 12, 13, 14, typically at or very near the level of the factory floor. As can also be appreciated from FIG. 1, the dust collectors 18 of the illustrated embodiment may lead into a common vertical duct 20.

Each tissue-machine cleaning dust collector 18 is connected to a common fan or blower 28 and a filtration system 30 that separate the paper dust and fibers from the effluent stream and may, in some cases, return the separated dust and fibers to a tissue-machine (not shown in FIG. 1) for reprocessing. The filter 30 may be, for example, a Venturi scrubber with a tank that holds and hydrates captured maculature and tissue paper for some period of time before returning it to the tissue-machine. The hood system 23 would typically be connected to the same fan or blower 28 and filtration system 30.

In various embodiments, when several tissue-machine cleaning dust collectors 18 are in use, they may be connected to a common material handling fan or blower 28, or they may be connected to individual systems. Moreover, if overhead dust collection hoods and floor-level dust collectors are used, both systems 18, 23 may be connected to the same fan or blower 28 by separate sets of ducts 20, 21. If both systems 18, 23 are intended to operate continuously and together, no further valve, manifold, or other flow-direction structure may be required. However, as in the illustrated embodiment, a pair of electronically activated auto-guillotine valves 22, 24 may be installed in order to allow the flow the common fan 28 to draw air selectively through the hood system 23, the floor-level dust collectors 18 or both. A bypass valve 26 is installed between the auto-guillotine valves 22, 24 and the fan or blower 28, so that if both the auto-guillotine valves 22, 24 are closed, the fan or blower 28 can draw from outside air and does not need to be halted or turned off (Depending on the embodiment, the fan or blower 28 may create enough of a pressure drop that if the valves 22, 24 are closed and the fan or blower 28 is thus isolated with no bypass, duct damage or collapse may occur.) While this description refers to certain types of valves, any structure that accomplishes the necessary function may be used, and those valves may be manual or automatic.

As can be appreciated from FIG. 1, the ducts 20, 21 direct air and dust from the production side of the machine 10, through a larger duct 25 that connects to the fan or blower 28, and finally towards the filter 30. Applicant has found it advantageous if the ducts 20, 21, 25 increase in diameter or cross-sectional area, (e.g., they step up in size) the closer they get to the fan or blower 28, thus ensuring sufficiently high airflow at the collectors 18.

While the particular capacity or volume at which the fan or blower 28 operates may vary, an airflow volume of about 30,000-70,000 cubic feet per minute (cfm) may be appropriate for a typical embodiment. In order to create such an airflow volume, the fan or blower 28 might be, e.g., 200-400 horsepower (hp). However, depending on the application, airflow and horsepower values higher or lower than the specified ranges can be used. Furthermore, to the extent that maculature, wads, and larger clusters of dust may reach the fan or blower 28, the blades of the fan or blower 28 should be capable of chopping and breaking up wads of paper before sending them to the filter 30. (U.S. Application No. 62/301,063, filed Feb. 29, 2016, which is also incorporated by reference in its entirety, discloses structures and methods for breaking up larger clumps at the hood.)

While the dust collectors 18 may be used continuously along with the hood system 23, more commonly, the overhead hood system 23 will be used continuously most of the time, while the dust collectors 18 are used to clean the machine 10 and the area around it at intervals, e.g., during a brief period in which production is halted, for example when a parent roll 15, 16 is being replaced.

In order to switch between the overhead hood system 23 and the dust collectors 18 and to clean the machine 10 with the dust collectors 18, an operator presses a button (not shown in FIG. 1) to activate the by-pass valve 26, temporarily isolating the blower 28 while the changeover is made.

Next, the operator closes the valve 24 that isolates and blocks off the main duct 21 leading to the hood system 23. Then, the operator opens the valve 22, opening the duct 20 that leads to the floor dust collectors 18. Finally, the operator presses a button to return the by-pass valve 26 to a position that allows airflow into the duct 20. When the airflow from the fan or blower 28 is routed through the duct 20, high volumes of air are drawn into the dust collectors 18, and are expected to capture accumulated dust from the machine 10 or the floor.

Generally speaking, there will be fewer floor dust collectors 18 than overhead dust collection hoods. Thus, comparatively speaking, airflow through the dust collectors 18 will be at a greater volume per unit of time than it is through the overhead hood system. As one example, the duct 21 for the overhead hood system 23 may have on the order of 8-12 branches to connect with the various hoods, as compared with four branches for the duct 20 that leads to the floor dust collectors 18 in FIG. 1.

Additionally, a plurality of air ramps 48 are adapted and positioned to produce periodic bursts of air, which serve to force accumulated dust towards the hoods 18. The air ramps 48 are particularly useful for dust that has accumulated just beyond an effective air draw distance of the high-volume airflow of the collectors 18. Air ramps 48 may be arranged in any configuration suitable to assist the collectors 18 in capturing dust; Applicant has found that, for example, that air ramps 48 pitched at about two meters are advantageous. Furthermore, while the plurality of air ramps 48 may be programmed to deliver periodic blasts of air with the same air pressure, they may also be configured to have different air pressures. For example, in some areas where small amounts of dust accumulate, lower air pressure is required to entrain or move the dust. By contrast, in an area where large quantities of dust accumulates, greater air pressure may be required to entrain or move dust towards the collectors 18.

After the machine 10 has been cleaned, the operator re-directs airflow to the hood duct 21 by first pressing the button to activate the by-pass valve 26 in a position that prevents air from flowing through the collectors 18 and the duct 20. Next, the operator closes the valve 22, opens the valve 24, and finally returns the by-pass valve 26 to a position that re-directs airflow through the dust collection hood duct 21 to the hood system 23. At this point, the machine 10 and factory floor area will typically be cleaner.

Figure 2:
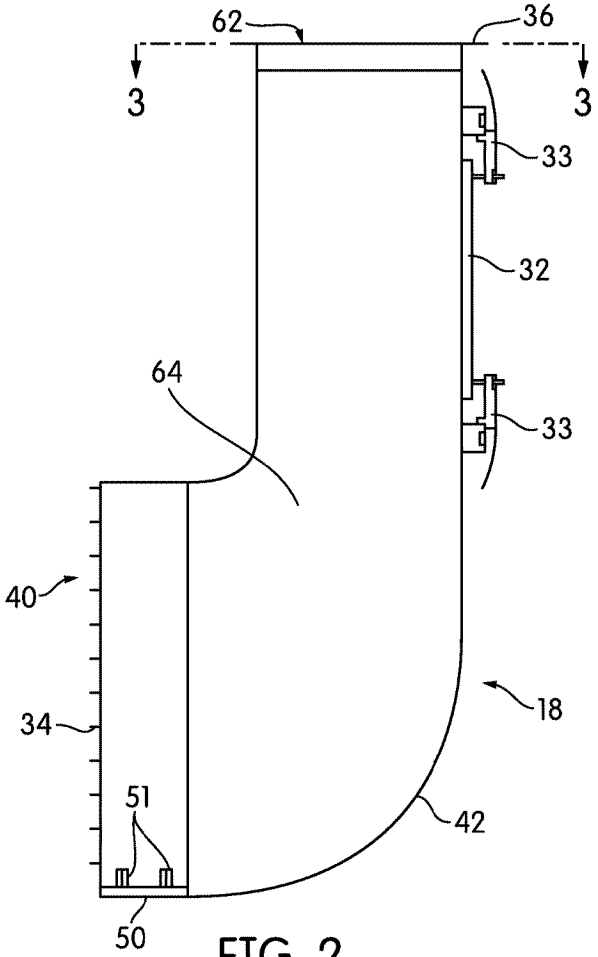
FIG. 2 is a side elevational view of one embodiment of one of the hoods of FIG. 1 in isolation.

FIG. 2 is a side elevational view of one embodiment of the tissue-machine cleaning dust collector 18 of FIG. 1 in isolation. The dust collector 18 has a body 64 with an air intake 40 that is positioned adjacent a surface where maculature or dust is known to accumulate, as shown in FIG. 1. In the illustrated embodiment, as was noted briefly above, the air intake 40 is oriented such that it extends generally horizontally from a generally vertical outlet 62. After the air intake 40, a 90° turn 42, generally resembling an elbow, directs airflow upward from the intake 40 towards the outlet 62. Immediately in front of the air intake 40 of the dust collector 18, a grill 34 is positioned and adapted to prevent larger clumps of paper from being captured and potentially clogging the dust collector 18—as will be described in greater detail below.

Figure 3:
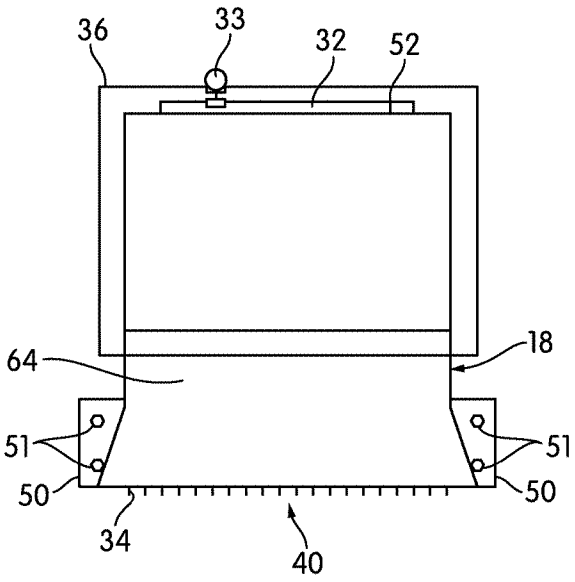
FIG. 3 is a cross sectional view taken through Line 3-3 of FIG. 2.

As can be appreciated from FIG. 2, airflow is directed upward after the turn 42, past an access hatch 32 to the outlet 62, which leads to the duct 20 or branch of the duct 20 that connects with the fan or blower 28 (not shown in FIG. 2). In the illustrated embodiment, the body 64 is generally rectangular, whereas the duct 20 is circular—an adapter 36 serves to join the rectangular body 64 of the dust collector 18 to the circular duct 20. The hatch 32, which allows for interior access to the body 64 for cleaning and maintenance, is positioned above the air intake 40 and grill 34 of the body 64. In some embodiments, the hatch 32 is positioned on an opposite side of the air intake 40; however, the placement of the hatch 32 is not critical. The dust collector 18 pulls air and dust first into the body 64 through the air intake 40, past the turn 42—where air is directed upward, past the access hatch 32 to the outlet 62 and into the duct 20. FIG. 3 further illustrates that the intake 40 extends horizontally where the grill 34 engages the air intake 40.

FIG. 3 is a cross sectional view taken through Line 3-3 of the dust collector 18 of FIG. 2 in isolation. As can be appreciated from FIG. 3, the body 64 is generally rectangular, and may be adapted to a round duct 20 with an adapter 36. The adapter 36 may be welded, bolted, crimped, taped, or otherwise secured by any suitable means to the duct 20 above the dust collector 18.

FIG. 3 further illustrates that the air intake 40 extends angularly from the body 64 along a horizontal plane, and defines a widest dimension where the grill 34 is positioned. As can be appreciated from FIG. 3, the greatest width of the air intake 40 may be greater that the width of the body 64, and may be of a generally similar width to the adapter 36. However, the air intake 40 may be wider than any portion of the body 64 below the adapter 36. While these particular proportions may be advantageous, various other suitable configurations or dimensions may be implemented.

As can be appreciated from FIG. 3, a mounting bracket 50 is positioned to extend from a bottom exterior edge of the air intake 40 and connects the body 64 to a factory floor with a plurality of suitable mechanical fasteners 51 (e.g., threaded bolts extending from the floor with corresponding threaded nuts placed over the bracket 51).

Figure 4:
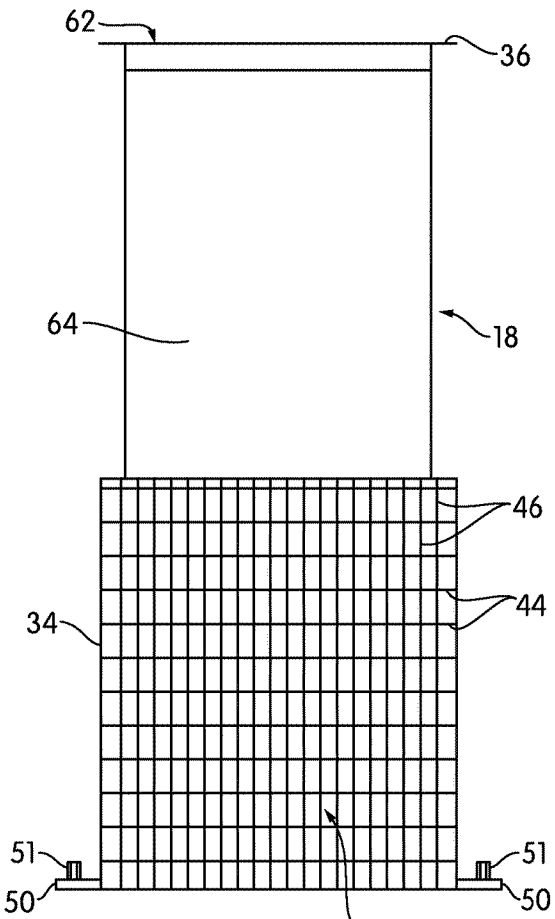
FIG. 4 is a front elevational view of the hood of FIG. 2.

FIG. 4 is a front elevational view of the dust collector 18 of FIG. 2 in isolation, showing the air intake 40 and the grill 34 in greater detail. The grill 34 extends over the entirety of the air intake 40, i.e., from a top edge to a bottom edge and from one side edge to the opposite side edge. The grill 34 is intended to prevent large chunks of paper from entering the air intake 40, further preventing the dust collector 18 and the duct 20 from potentially clogging.

As can be appreciated from FIG. 4, the grill 34 comprises both horizontal bars 44 and vertical bars 46 spaced perpendicularly at a regular pitch across the air intake 40. The bars 44, 46 of the grill 34 may be round, having a fixed diameter. While different sizes of bars may be particularly suited to specific types of tissue production, one-quarter inch diameter bars 44, 46 may be appropriate for general tissue production. Additionally, while the bars 44, 46 may be spaced evenly across the air intake 40, Applicant has found an advantageous configuration of the grill 34 to have more vertical bars 46 than horizontal bars 44. For example, Applicant has found it advantageous to space the horizontal bars 44 at a pitch of two inches, while the vertical bars 46 are spaced at a pitch of one-inch. However, the bars 44, 46 may be disposed in any orientation or at any pitch as along as they prevent larger chunks of paper from entering the dust collector 18.

The air intake 40 is generally taller than it is wide. A tall air intake 40 is helpful to the efficiency of the dust collector 18; if a lower portion of the air intake 40 becomes clogged, air may still pass through an upper portion of the air intake 40. For example, an interior intake height of 2 feet (0.61 meters) may be suitable in some embodiments, as compared with a width of 1.75 feet (0.53 meters). In some embodiments, the air intake 40 may have a lesser width dimension at the bottom of the air intake 40, and a greater width at the top of the air intake 40, giving it an at least slightly trapezoidal shape.

Figure 5:
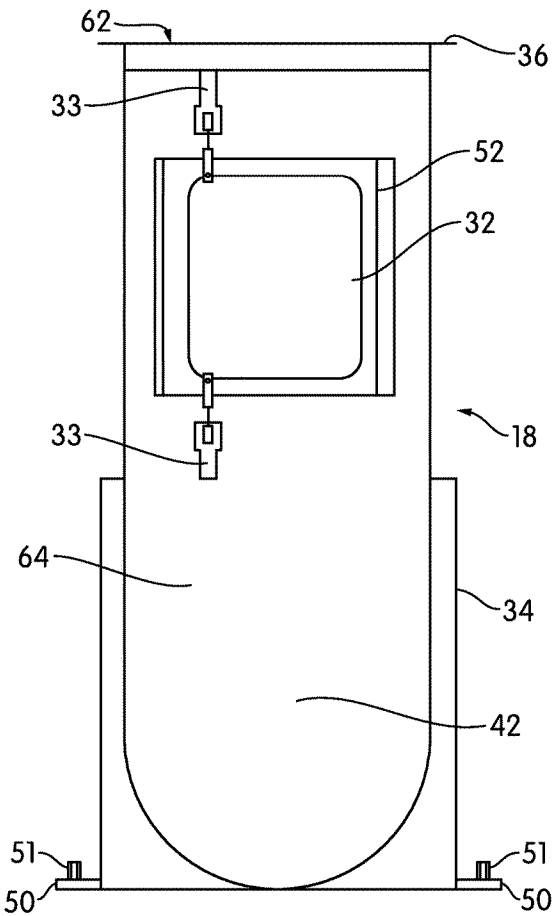
FIG. 5 is a rear elevational view of the hood of FIG. 4.

FIG. 5 is a rear elevational view of the dust collector 18 of FIG. 4 in isolation, showing the access hatch 32 in greater detail. The access hatch 32 is positioned on the body 64 opposite and above the air intake 40, and below the angled flange 36; however, in some embodiments the access hatch 32 could be positioned on the same side and above the air intake 40. As can be appreciated from FIG. 5, the access hatch 32 is connected to the body 64 by a hinge 52 and is secured in a closed position with a plurality of latches 33. In some embodiments, a single latch 33 may be adapted to secure the hatch 32 in a closed position. Generally, when the hatch 32 is secured in a closed position, the hatch 32 is expected to be at least mostly airtight (i.e., a slight leakage might occur, but that is dwarfed by the volume going through the air intake 40).

When the dust collector 18 becomes clogged (i.e., when airflow through the dust collector 18 is impeded), after air flow to the particular dust collector 40 is blocked off, the latches 33 may be released by an operator, allowing the hatch 32 to open on its hinge 52. Once the dust collector 18 has been cleaned, the access hatch 32 is returned to and secured in the closed position with the latches 33. For safety reasons, a cleaning operation involving the hatch 32 is best executed while airflow is temporarily suspended from being directed into the dust collector 18. Although not shown in the figures, a valve or movable baffle could be provided to isolate an individual dust collector 18 from the flow.

Figure 6:
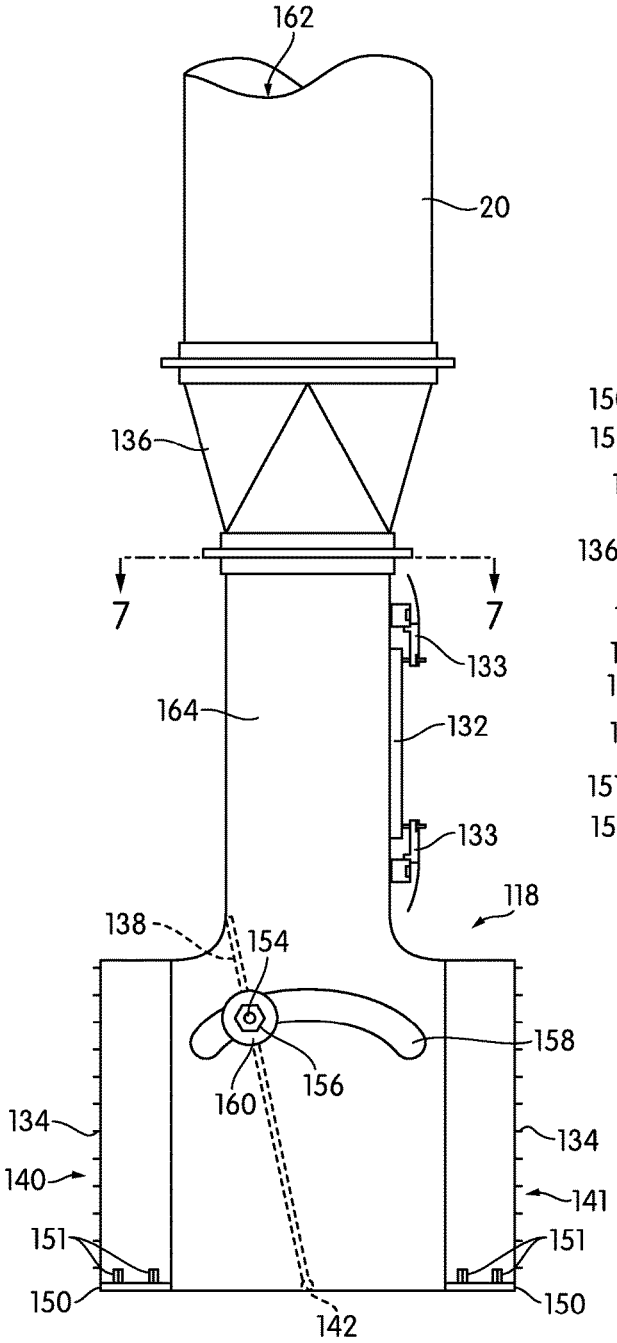
FIG. 6 is a side elevational view of another embodiment of the hood of FIG. 1.

FIG. 6 is a side elevational view of another embodiment of the collector 118 of FIG. 1 in isolation. As can be appreciated from FIG. 6, the collector 118 has a body 164 that defines two air intakes 140, 141. The air intakes 140, 141 are of the same dimensions; however, in some embodiments, it may be advantageous to give each air intake 140, 141 different dimensions or other characteristics.

The pair of air intakes 140, 141 are positioned in-line and facing opposite directions (i.e., the intake 140 is 180° in-line with respect to the second intake 141; they are back-to-back with respect to one another). This particular configuration of air intakes 140, 141 is advantageous for drawing air at high velocities from two opposite directions, either one direction at a time, or simultaneously—especially where dust is expected to accumulate on both sides of the collector 118. In another embodiment, intended for use, for example, in a corner area of a factory, one intake 140 could be disposed at a right angle (e.g., 90°) with respect to the second intake 141. However, the particular angle at which the two intakes 140, 141 of the collector 118 are configured may vary depending on the specific location that dust accumulates along the machine 10.

In order to allow an operator or system configurer to select how the flow is divided between the two intakes 140, 141 or, in some cases, which intake 140, 141 receives the flow in a dual entry collector 118, an internal directional baffle 138 is adapted to be disposed in a particular position. The directional baffle 138 is attached internally to the body 164 with a hinge 142. The baffle 138 is generally longer than it is wide and may be made of a single sheet of galvanized sheet metal, or in some cases, may be a plurality of pieces of galvanized sheet metal joined together. In order for the directional baffle 138 to be positioned and locked into a selected position, a rod 154 is fixedly attached to the baffle 138. A pair of arcuate slots 158 are provided in opposite upper sidewalls of the body 164. The rod 154 is fixed across a plane that is defined by the directional baffle 138 at a height that will allow the rod 154 to protrude through and slide along the slots 158. As was described above, the rod may be fixed to the baffle 138 by welding, mechanical fasteners or by any appropriate means.

The rod 154 may be threaded over its entire length; however, typically at least the end portions of the rod 154 would be threaded or otherwise modified to engage hardware to secure it in place. The rod 154 is dimensioned such that the pair of mechanical nuts or knobs 156 may be threaded onto each end of the protruding rod 154 and be tightened sufficiently to prevent the directional baffle 138 from moving freely during operation. In order to change the position of the baffle 138, an operator may loosen the pair of nuts or knobs 156, at which point the baffle 138 may pivot freely on the hinge 142. Of course, in some circumstances, the baffle 138 may be secured in any desired position by tightening only one of the nuts or knobs 156, rather than both; this may be based on operator preference. Similarly, only one side of the rod 154 may be threaded to receive a nut or knob 156, while the opposite end of the rod 154 may have a fixed end, for example, a carriage bolt. If necessary or desirable, components may be added to block airflow into the slots 158; however, that may not be necessary—even if left open, the airflow into the slots 158 would typically be dwarfed by the volume of air flowing into the intakes 140, 141.

Above the slots 158 and directional baffle 138, a cleaning hatch 132 is centrally positioned on the body 164 on the side of the second air intake 141. The cleaning hatch 132 is fastened in a closed position with a plurality of latches 133 and a hinge 152 (best seen in FIGS. 7 and 8). When the collector 118 requires cleaning, an operator may gain access to the interior of the hood via the cleaning hatch 132. The cleaning hatch 132 may be positioned on any side of the body 164, however Applicant has found it advantageous to place the hatch 132 above one of the air intakes 140, 141. Above the hatch 132 is an air outlet 162 that directs air through an adapter 136, which adapts and connects the collector 118 to the duct 20. As was described above, this connection may be welded or fixed with any means deemed suitable by the Applicant.

Figure 7:
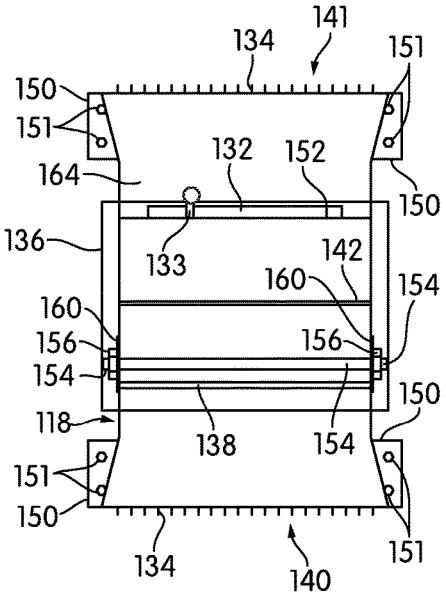
FIG. 7 is a cross sectional view taken through Line 6-6 of FIG. 6.

FIG. 7 is a cross sectional view taken through Line 7-7 of FIG. 6. As can be appreciated from FIG. 7, the body 164 is generally rectangular; the adapter 136 adapts the rectangular body 164 to the round duct 20. Additionally, the air intakes 140, 141 are essentially symmetrical, having a wider dimension at the extremity of each intake 140, 141 where the grill 134 is adapted to cover. Furthermore, the rod 154 extends just beyond a width of the body 164, such that the rod 154 may protrude sufficiently from the pair of coinciding slots 158 to allow a pair of nuts or knobs 156 to engage the rod 154, thus securing the baffle in a desired position.

Figure 8:
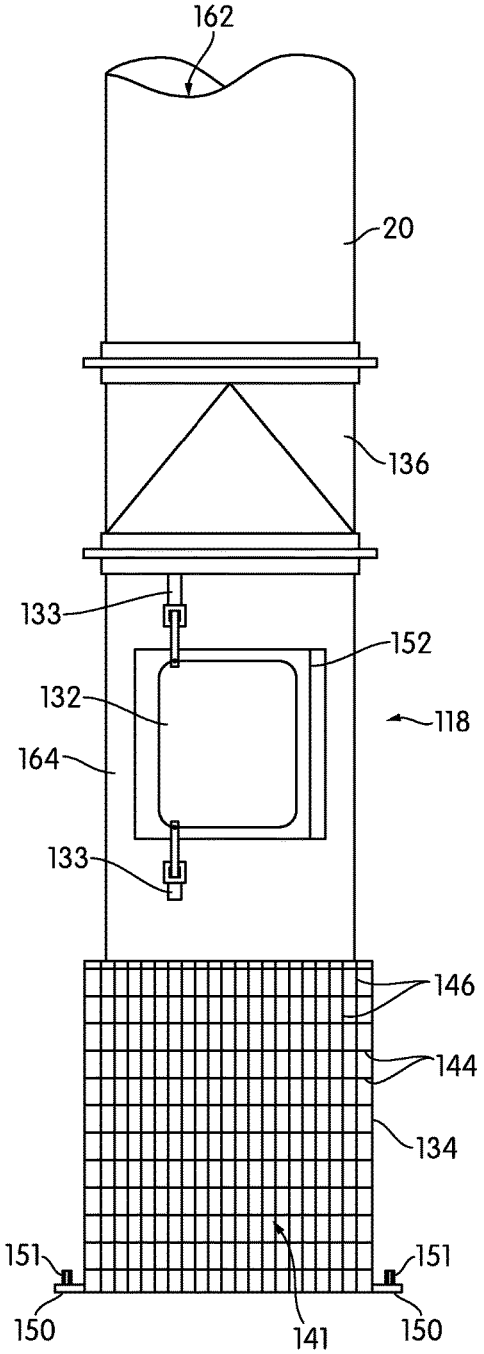
FIG. 8 is a front elevational view of the hood of FIG. 6.

FIG. 8 is a front elevational view of the collector 118 of FIG. 6 in isolation. As can be appreciated from FIG. 8, the air intake 141 is covered entirely with a grill 134. Similar to the grill 34 of the dust collector 18, the grill 134 comprises both horizontal bars 144 and vertical bars 146 spaced at regular intervals across the air intake 141. The bars 144, 146 of the grill 134 may be round, having a fixed diameter; while Applicant notes that while different sizes of bars 144, 146 may be particularly suited to specific types of tissue production, one-quarter inch diameter bars 144, 146 are advantageous for the combining re-winder machine 10 during tissue production. Additionally, while the bars 144, 146 may be spaced evenly across the air intake 141, Applicant has found the preferred configuration of the grill 134 to have more vertical bars 146 than horizontal bars 144. For example, Applicant has found it advantageous to space the horizontal bars 144 at a pitch of two inches, while the vertical bars 146 are spaced at a pitch of one-inch. Applicant notes however that the bars 144, 146 may be disposed in any orientation or at any pitch as along as they prevent large chunks of paper from entering the collector 118.

As with the embodiment described above, air intake 141 is generally taller than it is wide. The height of the air intake 141 allows air to pass through an upper portion of the air intake 141, even if a lower portion becomes clogged. In an additional embodiment of the collector 118, the air intake 141 may have a smaller width dimension at the bottom, and a greater width at the top of the air intake 141, making for example, a trapezoidal shape.

Figure 9:
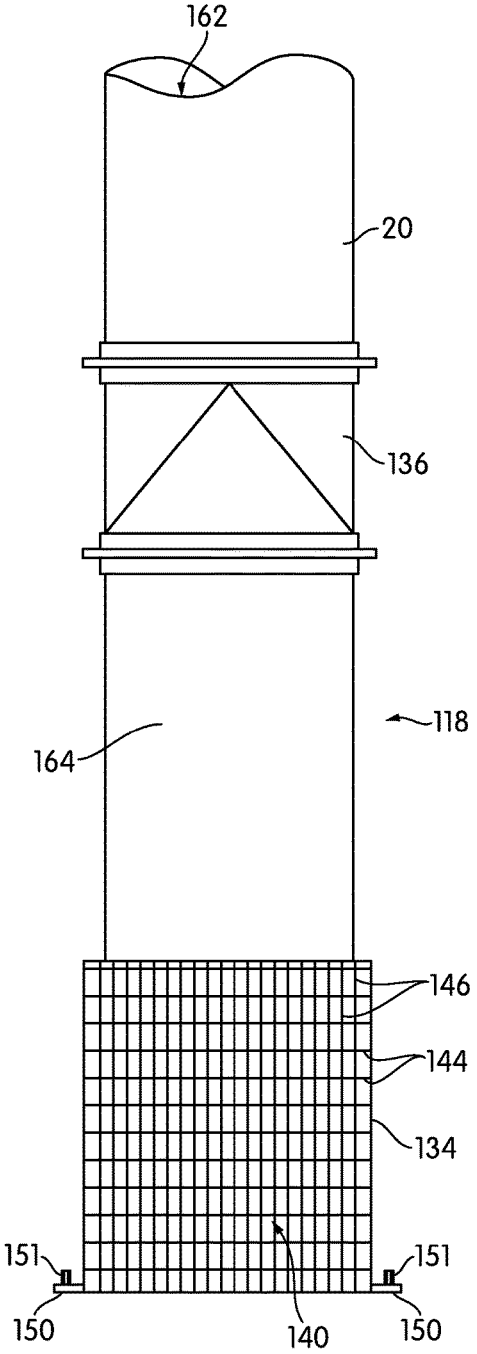
FIG. 9 is a rear elevational view of the hood of FIG. 6.

FIG. 9 is a rear elevational view of the collector 118 of FIG. 6 in isolation similar to the view of FIG. 8. As can be appreciated from FIG. 9, a series of mounting brackets 150 extend laterally from and secure the body 164 to a surface, for example a factory floor. The collector 118 may be secured a surface with a plurality of any type of appropriate mechanical fastener 151 (e.g., a threaded bolt extending from the floor with a corresponding threaded-nut placed over the bracket 51).

Figure 10:
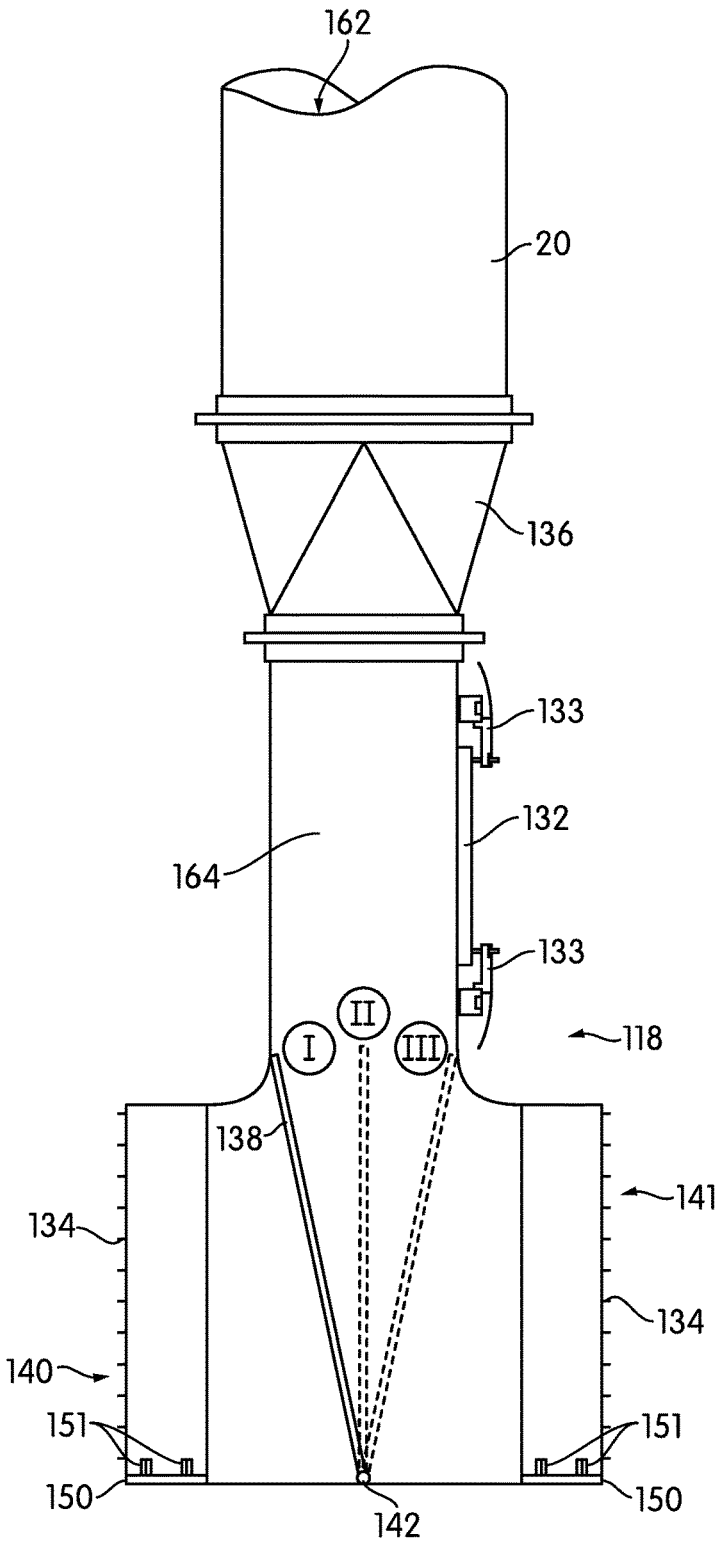
FIG. 10 is a side elevational phantom view of the hood of FIG. 6 in isolation, illustrating its directional baffle.

FIG. 10 is a side elevational phantom view of the collector 118 of FIG. 6 in isolation, illustrating its directional baffle 138. The directional baffle 140 is attached to a base of the body 164 by a hinge 142, and is allowed to assume at least three positions I, II, III found advantageous to cleaning a tissue machine 10.

As can be appreciated from FIG. 10, when the directional baffle 138 is secured in position I, the collector 118 draws air through one air intake 141; the air intake 140 is blocked when the baffle 138 is disposed in position I. Alternately, when the baffle 138 is disposed in position III, the collector 118 draws air through the opposite air intake 140; the air intake 141 is blocked when the baffle 138 is disposed in position III. Alternatively, when the baffle 138 is disposed in position II, the collector 118 may draw air through both air intakes 140, 141 simultaneously. In other words, while the directional baffle 138 selects which air intake 140, 141, is preferred, the baffle 138 may be disposed in at least one position advantageous for drawing air through both intakes 140, 141 simultaneously.

The directional baffle 138 is dimensioned such that it may pivot within the body 164; generally extending longitudinally in a straight line from the hinge 142 upward until just below the access hatch 132. Additionally, the baffle 138 extends laterally within the body 164 such that it may pivot freely upon the hinge 142 while preventing a significant airflow from entering at the space between the side walls of the body 164. In other words, the baffle 138 is longer than it is wide. The baffle 138 is generally a single planar rectangle that may be made of, for example a single piece of 12 gauge galvanized steel sheet metal. Additionally, the baffle 138 may be a plurality of galvanized sheets of metal having been joined or welded by any appropriate method known to those of skill in the art. Furthermore, while the curved slots 158 may define limitations for the extent to which the baffle 138 may be disposed, the upper portion of the body 164 may provide some limitation to the amount that the baffle 138 may pivot within the body 164. While the directional baffle 138 has been described with respect to three different positions I, II, III, the slots 158 may allow any number of potential positions that may be useful. Additionally, the curved slots 158 could be adapted to have preferred locations where the rod 154 and bolt or knob 156 may engage with a notch (not shown in FIG. 10).

While the invention has been described with respect to certain embodiments, the embodiments are intended to be exemplary, rather than limiting. Modifications and changes to the invention may be made within the scope of the invention.

What is claimed is:

1. A dust control system, comprising:

a fan or blower;

at least one main duct connected to, and in fluid communication with, the fan or blower, the at least one main duct extending above floor level;

at least one pneumatic dust collector assembly, including a branch duct connected to the at least one main duct, the branch duct extending downwardly, toward the floor level, a vertical outlet portion with an open outlet connected to the branch duct, and unitary first and second intake portions contiguous with the vertical outlet portion, the first and second intake portions each making a turn relative to the vertical outlet portion to extend horizontally, such that a shared bottom of the first and second intake portions rests along floor level, with each of the first and second intake portions extending in a different direction, the first and second intake portions terminating at respective first and second intake openings, the first and second intake openings (a) defining the greatest cross-sectional dimensions of the first and second intake portions, respectively, and (b) having heights greater than their widths; and at least one air ramp positioned at the floor level and adapted to produce periodic bursts of air to direct dust toward the dust collector assemblies.

2. The dust control system of claim 1, wherein the first and second intake portions extend in opposite directions.

3. The dust control system of claim 1, wherein the at least one pneumatic dust collector assembly further comprises a directional baffle hingedly mounted on the shared bottom of the first and second intake portions, between the first and second intake openings and in-line with the vertical outlet portion.

4. The dust control system of claim 3, wherein the first and second intake portions have at least one pair of shared sidewalls that arise from the shared bottom.

5. The dust control system of claim 4, wherein the at least one pair of shared sidewalls have a pair of corresponding arcuate slots formed therein.

6. The dust control system of claim 5, wherein the directional baffle further comprises a rod fixed to the directional baffle with respective ends, spaced from one another, that extend between the at least one pair of shared sidewalls and into the pair of corresponding arcuate slots;

wherein the respective ends of the rod are releasably secured within the pair of corresponding arcuate slots by one or more fasteners.

7. The dust control system of claim 1, wherein the at least one pneumatic dust collector assembly has the general shape of an inverted T.

8. The dust control system of claim 1, further comprising:

a second pneumatic dust collector assembly, including a second branch duct connected to the at least one main duct, the second branch duct extending downwardly, toward the floor level, a second vertical outlet portion with an open outlet connected to the branch duct, and a third intake portion contiguous with the vertical outlet portion, the third intake portion making a turn relative to the vertical outlet portion to extend horizontally, such that a bottom of the third intake portion rests at floor level, the third intake portion defining its greatest cross-sectional dimensions at a third intake opening, the third intake opening having a height greater than its width.

9. The dust control system of claim 8, wherein each of the at least one pneumatic dust collector assemblies includes a grill disposed over each respective intake opening.

10. The dust control system of claim 1, further comprising a first valve in the at least one main duct, the first valve being constructed and adapted to isolate the at least two pneumatic dust collector assemblies from the fan or blower.

11. The dust control system of claim 10, further comprising a dust control hood system connected to the fan or blower through at least one second duct.

12. The dust control system of claim 11, further comprising a second valve constructed and arranged in the at least one second duct to isolate the dust control hood system from the fan or blower.

13. The dust control system of claim 12, further comprising a bypass valve between the fan or blower, the at least one main duct and the at least one second duct.

14. The dust control system of claim 1, wherein the fan or blower is adapted to produce an airflow volume of at least 30,000 cubic feet per minute (CFM).

15. The dust control system of claim 14, wherein the fan or blower is adapted to produce an airflow volume of between 30,000 and 70,000 CFM.

16. The dust control system of claim 15, wherein the at least one pneumatic dust collector assembly comprises four pneumatic dust collector assemblies.

17. The dust control system of claim 1, wherein the branch duct, the vertical outlet portion, and the first intake portion are fixed in position.

* * * * *